United States Patent [19]

Lolic

[11] Patent Number: 4,540,235

[45] Date of Patent: Sep. 10, 1985

[54] DOUBLE FLAT SPRING CONTACT PROVIDED WITH AN OVER-SPRING

[75] Inventor: Srboslav Lolic, Wuppertal, Fed. Rep. of Germany

[73] Assignee: Grote & Hartmann GmbH & Co. KG, Fed. Rep. of Germany

[21] Appl. No.: 551,117

[22] Filed: Nov. 14, 1983

[30] Foreign Application Priority Data

Dec. 24, 1982 [DE] Fed. Rep. of Germany ..... 3248078

[51] Int. Cl.[3] ..... H01R 13/18; H01R 11/22

[52] U.S. Cl. ..... 339/259 F; 339/258 S; 339/262 R

[58] Field of Search ..... 339/256 R, 256 SP, 258 R, 339/258 F, 258 S, 258 P, 259 R, 259 F, 262 R, 252 R, 253 R, 255 R

[56] References Cited

U.S. PATENT DOCUMENTS 4,040,713 8/1977 Könnemann ..... 339/259 R

FOREIGN PATENT DOCUMENTS 37995 10/1981 European Pat. Off. ..... 339/258 S
1276672 10/1961 France ..... 339/258 R
1427747 1/1966 France ..... 339/258 F
475699 9/1975 U.S.S.R. ..... 339/258 R

*Primary Examiner*—Gil Weidenfeld
*Assistant Examiner*—Steven C. Bishop
*Attorney, Agent, or Firm*—Goodman & Teitelbaum

[57] ABSTRACT

A double flat spring contact provided with an over-spring, in which the double flat spring contact includes connecting elements for an electrical conductor wire and a box-shaped spring arm base which is rectangular in cross section to define a bottom, side walls and a pair of longitudinally divided top cover parts. A spring arm extends forward from each cover part and a pair of spring arms are also connected to the bottom. An external over-spring is seated about in an enclosed arrangement on the spring arm base to be unreleasably secured thereon. The external over-spring includes a box-shaped external over-spring arm base, which is also rectangular in cross section. Connected to and extending forward from the over-spring arm base are over-spring clamp arms that run parallel to the spring arms of the double flat spring contact. The clamp arms press inwardly upon outer surfaces of the spring arms.

11 Claims, 10 Drawing Figures

DOUBLE FLAT SPRING CONTACT PROVIDED WITH AN OVER-SPRING

This invention relates to an electrical double flat spring contact provided with an over-spring.

Electrical double flat spring contacts are produced from stamped sheet metal parts. Internal over-spring that are arranged between the spring arm contacts are known in the prior art, as described in German Pat. No. 24 55 140. Furthermore, an external over-spring for a so-called telephone connector is also known in the prior art. This external over-spring, however, is not suited for a double flat spring contact.

An object of the present invention is to provide a double flat spring contact with an external over-spring, in which the external over-spring is made from a stamped sheet metal part, has a relatively uncomplicated form, and does not substantially increase the external dimensions of the double flat spring contact. Furthermore, the external over-spring must be able to be arranged easily on the double flat spring contact so that it is unreleasably secured on the double flat spring contact.

The above objects are obtained by the features of the present invention.

With the above and additional objects and advantages in view, as will hereinafter appear, this invention comprises the devices, combinations and arrangements of parts hereinafter described by way of example, and illustrated in the accompanying drawings of preferred embodiments in which.

In the various figures of the drawings, like reference characters designate like parts.

Figure 1:
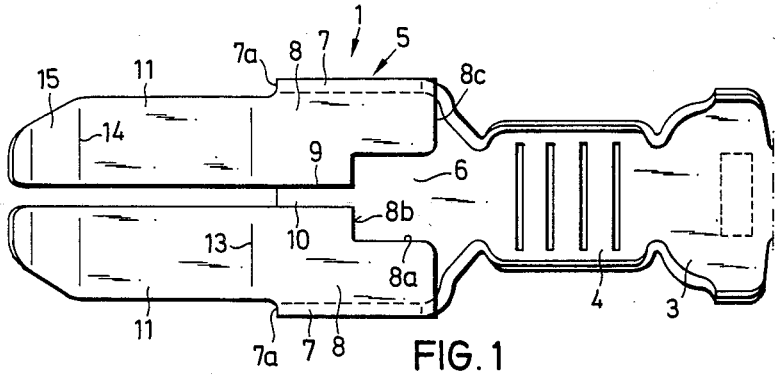
FIG. 1 shows a top plan view of a double flat spring contact in accordance with the present invention.

Referring now to FIG. 1 of the drawings, the double flat spring contact 1, which according to the present invention can be fitted with an external over-spring, includes the following elements as viewed from the rear to front portion thereof: an insulating securing portion 3, a conductor wire securing portion 4, a box-shaped spring arm base 5 which is rectangular in cross section, and spring arms secured to the spring arm base 5.

The box-shaped spring arm base 5 includes a bottom 6, two side walls 7 provided with free front edges 7*a*, and longitudinally divided top cover parts 8. In the longitudinal middle thereof, the edges 9 of the cover parts 8 are spaced from one another, so that there is provided a slit 10 therebetween. From each cover part 8, there extends forward a spring arm 11.

Figure 8:
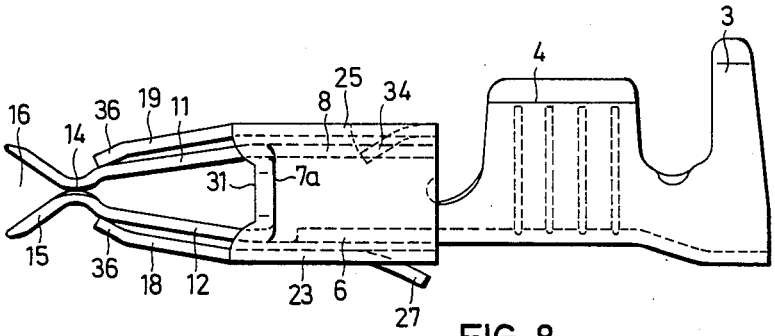
FIG. 8 shows a side view of the double flat spring contact provided with the external over-spring.
Figure 9:
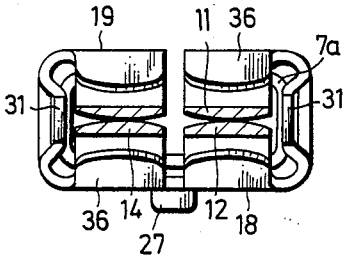
FIG. 9 shows a cross section view of the embodiment of FIG. 8 with the rear securing portions removed.

The spring arms are spaced apart, in the longitudinal middle of the spring contact 1, by the width of the slit 10, so that the slit 10 continues forward unaltered from the spring arm base 5. In the coverage underneath the spring arms 11, there are arranged the spring arms 12, which are bound to the bottom 6, as shown in FIGS. 8 and 9, and therefore, not visible in FIG. 1. The spring arms 11 and 12 are bent inward at the bend lines 13, so that they converge on one another and touch at the bend line 14, as shown in FIGS. 8 and 9. From the bend line 14, the end portions 15 of the spring arms diverge from one another to form a funnel type opening 16, as shown in FIG. 8.

It is essential that an angle portion is cut out in each cover part 8, preferably a right angle portion, so that in each case a cut-out longitudinal edge 8*a* and an adjacent cut-out transverse edge 8*b* is provided, the function of which is described further below.

Figure 2:
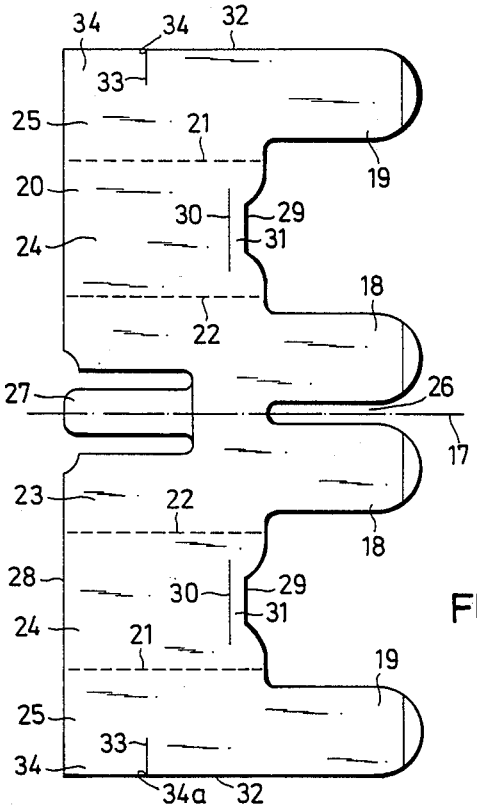
FIG. 2 shows a plan view of a blank for forming an external over-spring in accordance with the present invention.

The blank of the external over-spring is constructed symmetrically to the axis 17, as shown in FIG. 2, and includes in each case lower clamp arms 18 and upper clamp arms 19, the clamp arms being spaced from one another by connection to an over-spring arm base 20. The over-spring arm base 20 is subdivided by the bend lines 21, 22 into a bottom section 23, side wall sections 24, and top cover wall sections 25.

Between the clamp arms 18, there is provided a slit 26 which corresponds to the width of the above mentioned slit 10 of the double flat spring contact 1. In the other side of the arm base 20, on the same axis 17 as the slit 26, there is cut a tongue stop 27, the free end of the tongue stop extending to the rear edge 28 of the over-spring arm base 20. Parallel to the front edge 29 of the side wall sections 24, a cut-through 30 is provided so that a narrow arresting strip 31 is obtained. Moveover, in the outer edges 32 of the over-spring arm base 20, a short incision 33 running parallel to the rear edge 28 is provided to obtain the tabs 34.

Figure 3:
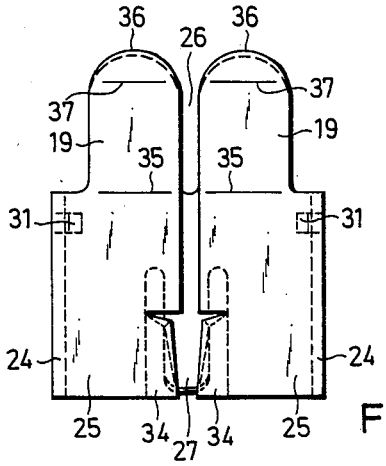
FIG. 3 shows a top plan view of the external over-spring formed from the blank of FIG. 2.
Figure 4:
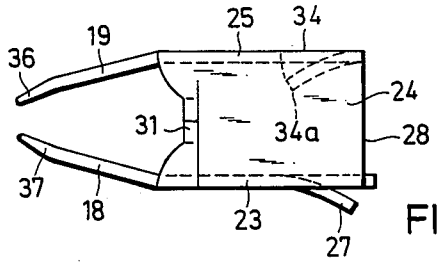
FIG. 4 shows a side view of the external over-spring.
Figure 5:
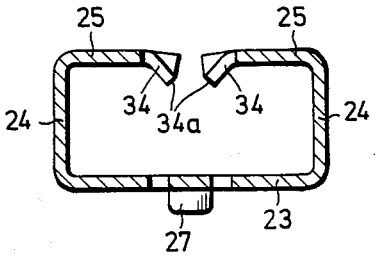
FIG. 5 shows a cross section view through the external over-spring of FIG. 3.
Figure 6:
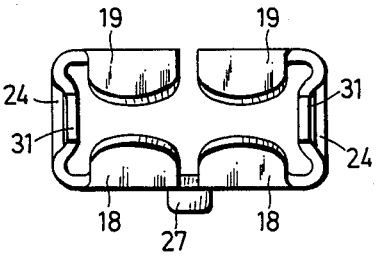
FIG. 6 shows a front view of the external over-spring.

The blank of the external over-spring is bent about the bend lines 21 and 22 so that the box-shaped external spring arm base 20 is formed, being rectangular in cross section as shown in FIGS. 3 to 6. The outer edges 32 lie opposite one another with a spacing therebetween equal to the width of the slit 26, as shown in FIGS. 3 and 6. At the bend line 35, shown in FIG. 3, the over-spring clamp arms 18, 19 are bent inward toward each other so that they converge, as shown in FIGS. 4 and 6. The ends 36 of the clamp arms 18, 19, however, are spaced from one another. At the break line 37, shown in FIG. 3, the clamp arms 18, 19 are again bent somewhat inward so that the ends 36 are directed towards each other whiile still being spaced apart.

Figure 10:
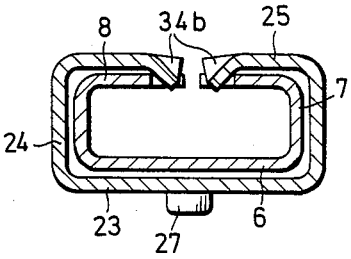
FIG. 10 shows another cross section view of the embodiment of FIG. 8 with the rear securing portions removed.

According to the present invention, the tabs 34 with their points 34*a* are bent inward into the box-shaped external over-spring arm base 20, and the arresting strips 31 are pressed inward towards each other, as shown in FIGS. 4, 5 and 6. The tongue stop 27 is bent outward away from the double flat spring contact, as shown in FIGS. 8, 9 and 10.

The external over-spring is seated on the box-shaped arm base 5 of the double flat spring contact 1, as shown in FIGS. 7 to 10. When assembled, the over-spring arm base 20 of the external over-spring is somewhat longer than the spring arm base 5 of the double flat spring contact to enclose over the spring arm base 5. The clamp arms 18 and 19, as viewed in the top plan of FIG.

7, run parallel to the spring arms 11, 12 of the double flat spring contact 1, where the width of the clamp arms 18 and 19 corresponds substantially to the width of the spring arms 11 and 12. The clamp arms 18 and 19 are, however, made shorter than the length of the spring arms 11 and 12, so that the clamp arms 18 press, slightly before the bend line 14, upon the outer surfaces of the spring arms 11, 12 of the double flat spring contact.

Figure 7:
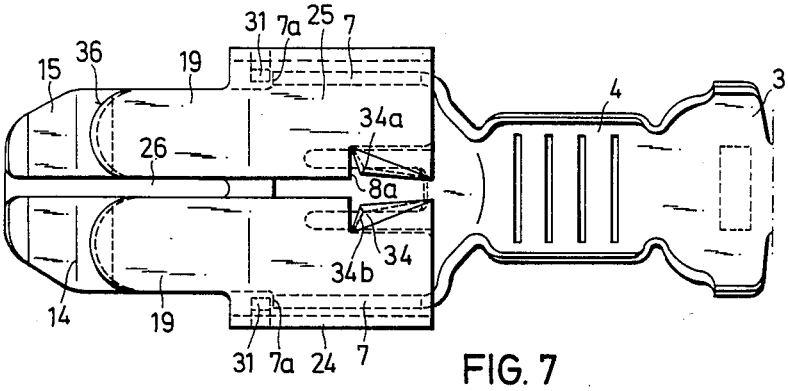
FIG. 7 shows a top plan view of the double flat spring contact provided with the external over-spring.

The rear edge 28 of the external over-spring is in alignment with the rear edge 8*c* of the spring arm base 5 of the double flat spring contact so that these rear edges are in the same transverse plane. The cut-through 30 in each of the over-spring arm bases 20 of the external over-spring is positioned at an associated one of the front edges 7*a* of the side walls 7 of the double flat spring contact to be in alignment therewith and run parallel thereto. Thereby, each cross piece 31 grips in front of its associated front edge 7*a*, as shown in FIGS. 7, 8 and 9, so that a sliding back of the external over-spring on the double flat spring contact is prevented.

The incisions 33 are arranged to cooperate with the cut-throughs 30 for securing the external over-spring. The incisions 33 are positioned to be in alignment with and run parallel to the edges 8*b*, respectively, of the cover parts 8. By bending the points 34*a* of the tabs 34 inward, the edges 34*b* of the tabs 34 of the external over-spring grip over the edges 8*b*, respectively, of the double flat spring contact, as shown best in FIG. 10, so that a displacement of the external over-spring forward on the double flat spring contact is prevented. The external over-spring, fabricated from steel, is thereby firmly seated on the double flat spring contact in an unreleasable arrangement.

Numerous alterations of the structure herein disclosed will suggest themselves to those skilled in the art. However, it is to be understood that the present disclosure relates to a preferred embodiment of the invention which are for purposes of illustration only and are not to be construed as a limitation of the invention.

What is claimed is:

1. A double flat spring contact provided with an over-spring, comprising:

said double flat spring contact including connecting elements for an electrical conductor wire and a box-shaped spring arm base, said spring arm base being rectangular in cross section to provide a base bottom, opposing side walls and a pair of longitudinally divided top cover parts;

a spring arm extending forward from each cover part;

a pair of spring arms connected to a forward portion of said base bottom;

each of said cover parts being provided with a cut out having a right angle to provide a cut-out longitudinal edge and a cut-out transverse edge;

an external over-spring including a box-shaped external over-spring arm base member having a rectangular cross section;

over-spring clamp arms connected to and extending forward from said over-spring arm base member;

said external over-spring being seated about in an enclosed arrangement on said spring contact with said over-spring arm base member being mounted on said spring arm base, and said clamp arms running parallel to associated ones of said spring arms of said double flat spring contact respectively, and with said clamp arms pressing inwardly upon respective outer surfaces of said associated spring arms; and securing means joining said over-spring arm base member to said spring arm base of said spring contact to provide an unreleasable securement of said external over-spring on said spring contact;

securing means extending into each said cut out of said cover parts of said spring arm base to provide said unreleasable securement.

2. A double flat spring contact according to claim 1, wherein associated ones of said spring arms are each bent inward toward each other from a first bend line and touch each other at a second bend line with end portions of said associated spring arms running divergently apart to provide an entry funnel.

3. A double flat spring contact according to claim 2, wherein associated ones of said over-spring clamp arms are each bent inward toward each other at a third bend line, and end portions of said associated clamp arms are bent further inward toward each other at a fourth bend line with a spacing therebetween.

4. A double flat spring contact according to claim 1, wherein said clamp arms and said spring arms have substantially equal widths, said clamp arms being shorter than said spring arms to press said respective outer surfaces before a bend line in each of said spring arms.

5. A double flat spring contact according to claim 4, wherein associated ones of said spring arms touch each other at said bend line.

6. A double flat spring contact according to claim 1, wherein side edges of said over-spring arm base member are provided with short incisions running parallel to a rear edge of said over-spring arm base member to provide two tabs thereon, said two tabs being bent inward with each tab point extending into an associated cut out of said cover parts of said spring arm base to provide said securing means.

7. A double flat spring contact according to claim 6, wherein cut-throughs are provided in said over-spring arm base member, said cut-throughs running parallel to a front edge of each side wall section of said over-spring arm base member to provide a narrow arresting strip in each said side wall section, each said arresting strip being pressed inward to engage an associated front edge of each of said side walls of said spring arm base of said double flat spring contact to provide additional securing means for joining said over-spring arm base member to said spring arm base of said spring contact to provide said unreleasable securement of said external over-spring on said spring contact.

8. A double flat spring contact according to claim 7, wherein associated ones of said spring arms are each bent inward toward each other from a first bend line and touch each other at a second bend line with end portions of said associated spring arms running divergently apart to provide an entry funnel.

9. A double flat spring contact according to claim 8, wherein associated ones of said over-spring clamp arms are each bent inward toward each other at a third bend line, and end portions of said associated clamp arms are bent further inward toward each other at a fourth bend line with a spacing therebetween.

10. A double flat spring contact according to claim 7, wherein said clamp arms and said spring arms have substantially equal widths, said clamp arms being shorter than said spring arms to press said respective outer surfaces before a bend line in each of said spring arms.

11. A double flat spring contact according to claim 10, wherein associated ones of said spring arms touch each other at said bend line.

* * * * *